US007359854B2

(12) United States Patent
Nilsson et al.

(10) Patent No.: US 7,359,854 B2
(45) Date of Patent: Apr. 15, 2008

(54) BANDWIDTH EXTENSION OF ACOUSTIC SIGNALS

(75) Inventors: Mattias Nilsson, Kungsängen (SE); Bastiaan Kleijn, Stocksund (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 1039 days.

(21) Appl. No.: 10/119,701

(22) Filed: Apr. 10, 2002

(65) Prior Publication Data

US 2003/0009327 A1 Jan. 9, 2003

(30) Foreign Application Priority Data

Apr. 23, 2001 (SE) ..... 0101408

(51) Int. Cl.
*G10L 19/04* (2006.01)

(52) U.S. Cl. ..... 704/219; 704/500; 704/268; 704/203

(58) Field of Classification Search ..... 704/203, 704/217, 268, 500, 501, 219, 223, 228, 221, 704/265, 262

See application file for complete search history.

(56) References Cited

U.S. PATENT DOCUMENTS 5,455,888 A * 10/1995 Iyengar et al. ..... 704/203
5,950,153 A * 9/1999 Ohmori et al. ..... 704/217
5,956,686 A 9/1999 Takashima et al. ..... 704/500
6,539,355 B1 * 3/2003 Omori et al. ..... 704/268

* cited by examiner

*Primary Examiner*—Huyen X. Vo
(74) *Attorney, Agent, or Firm*—Michael Cameron

(57) ABSTRACT

A solution for improving the perceived sound quality of a decoded acoustic signal is accomplished by extending the spectrum of a received narrow-band acoustic signal ($a_{NB}$). A wide-band acoustic signal ($A_{WB}$) is produced by extracting at least one essential attribute ($z_{NB}$) from the narrow-band acoustic signal ($a_{NB}$). Parameters, e.g., representing signal energies, with respect to wide-band frequency components outside the spectrum ($A_{NB}$) of the narrow-band acoustic signal ($a_{NB}$), are estimated based on the at least one essential attribute ($z_{NB}$). This estimation involves allocating a parameter value to a wide-band frequency component, based on a corresponding confidence level.

25 Claims, 6 Drawing Sheets

BANDWIDTH EXTENSION OF ACOUSTIC SIGNALS

THE BACKGROUND OF THE INVENTION AND PRIOR ART

The present invention relates generally to the improvement of the perceived sound quality of decoded acoustic signals. More particularly the invention relates to a method of producing a wide-band acoustic signal on basis of a narrow-band acoustic signal according to the preamble of claim 1 and a signal decoder according to the preamble of claim 24. The invention also relates to a computer program according to claim 22 and a computer readable medium according to claim 23.

Today's public switched telephony networks (PSTNs) generally low-pass filter any speech or other acoustic signal that they transport. The low-pass (or, in fact, band-pass) filtering characteristic is caused by the networks' limited channel bandwidth, which typically has a range from 0,3 kHz to 3.4 kHz. Such band-pass filtered acoustic signal is normally perceived by a human listener to have a relatively poor sound quality. For instance, a reconstructed voice signal is often reported to sound muffled and/or remote from the listener.

The trend in fixed and mobile telephony as well as in video-conferencing is, however, towards an improved quality of the acoustic source signal that is reconstructed at the receiver end. This trend reflects the customer expectation that said systems provide a sound quality, which is much closer to the acoustic source signal than what today's PSTNs can offer.

One way to meet this expectation is, of course, to broaden the frequency band for the acoustic source signal and thus convey more of the information being contained in the source signal to the receiver. For instance, if a 0-8 kHz acoustic signal (sampled at 16 kHz) were transmitted to the receiver, the naturalness of a human voice signal, which is otherwise lost in a standard phone call, would indeed be better preserved. However, increasing the bandwidth for each channel by more than a factor two would either reduce the transmission capacity to less than half or imply enormous costs for the network operators in order to expand the transmission resources by a corresponding factor. Hence, this solution is not attractive from a commercial point-of-view.

Instead, recovering at the receiver end, wide-band frequency components outside the bandwidth of a regular PSTN-channel based on the narrow-band signal that has passed through the PSTN constitutes a much more appealing alternative. The recovered wide-band frequency components may both lie in a low-band below the narrow-band (e.g. in a range 0.1-0.3 kHz) and in a high-band above the narrow-band (e.g. in a range 3.4-8.0 kHz).

Although the majority of the energy in a speech signal is spectrally located between 0 kHz and 4 kHz, a substantial amount of the energy is also distributed in the frequency band from 4 kHz to 8 kHz. The frequency resolution of the human hearing decreases rapidly with increasing frequencies. The frequency components between 4 kHz and 8 kHz therefore require comparatively small amounts of data to model with a sufficient accuracy.

It is possible to extend the bandwidth of the narrow-band acoustic signal with a perceptually satisfying result, since the signal is presumed to be generated by a physical source, for instance, a human speaker. Thus, given a particular shape of the narrow-band, there are constraints on the signal properties with respect to the wide-band shape. I.e. only certain combinations of narrow-band shapes and wide-band shapes are conceivable.

However, modelling a wide-band signal from a particular narrow-band signal is still far from trivial. The existing methods for extending the bandwidth of the acoustic signal with a high-band above the current narrow-band spectrum basically include two different components, namely: estimation of the high-band spectral envelope from information pertaining to the narrow-band, and recovery of an excitation for the high-band from a narrow-band excitation.

All the known methods, in one way or another, model dependencies between the high-band envelope and various features describing the narrow-band signal. For instance, a Gaussian mixture model (GMM), a hidden Markov model (HMM) or vector quantisation (VQ) may be utilised for accomplishing this modelling. A minimum mean square error (MMSE) estimate is then obtained from the chosen model of dependencies for the high-band spectral envelope provided the features that have been derived from the narrow-band signal. Typically, the features include a spectral envelope, a spectral temporal variation and a degree of voicing.

The narrow-band excitation is used for recovering a corresponding high-band excitation. This can be carried out by simply up-sampling the narrow-band excitation, without any following low-pass filtering. This, in turn, creates a spectral-folded version of the narrow-band excitation around the upper bandwidth limit for the original excitation. Alternatively, the recovery of the high-band excitation may involve techniques that are otherwise used in speech coding, such as multi-band excitation (MBE). The latter makes use of the fundamental frequency and the degree of voicing when modelling an excitation.

Irrespective of how the high-band excitation is derived, the estimated high-band spectral envelope is used for obtaining a desired shape of the recovered high-band excitation. The result thereof in turn forms a basis for an estimate of the high-band acoustic signal. This signal is subsequently high-pass filtered and added to an up-sampled and low-pass filtered version of the narrow-band acoustic signal to form a wide-band acoustic signal estimate.

Normally, the bandwidth extension scheme operates on a 20-ms frame-by-frame basis, with a certain degree of overlap between adjacent frames. The overlap is intended to reduce any undesired transition effects between consecutive frames.

Unfortunately, the above-described methods all have one undesired characteristic in common, namely that they introduce artefacts in the extended wide-band acoustic signals. Furthermore, it is not unusual that these artefacts are so annoying and deteriorate the perceived sound quality to such extent that a human listener generally prefers the original narrow-band acoustic signal to the thus extended wide-band acoustic signal.

SUMMARY OF THE INVENTION

The object of the present invention is therefore to provide an improved bandwidth extension solution for a narrow-band acoustic signal, which alleviates the problem above and thus produces a wide-band acoustic signal that has a significantly enhanced perceived sound quality. The above-indicated problem being associated with the known solutions is generally deemed to be due to an over-estimation of the wide-band energy (predominantly in the high-band).

According to one aspect of the invention the object is achieved by a method of producing a wide-band acoustic signal on basis of a narrow-band acoustic signal as initially described, which is characterised by allocating a parameter with respect to a particular wide-band frequency component based on a corresponding confidence level.

According to a preferred embodiment of the invention, a relatively high parameter value is thereby allowed to be allocated to a frequency component if the confidence level indicates a comparatively high degree certainty. In contrast, a relatively low parameter value is allowed to be allocated to a frequency component if the confidence level indicates a comparatively low degree certainty.

According to one embodiment of the invention, the parameter directly represents a signal energy for one or more wide-band frequency components. However, according to an alternative embodiment of the invention, the parameter only indirectly reflects a signal energy. The parameter then namely represents an upper-most bandwidth limit of the wide-band acoustic signal, such that a high parameter value corresponds to a wide-band acoustic signal having a relatively large bandwidth, whereas a low parameter value corresponds to a more narrow bandwidth of the wide-band acoustic signal.

According to a further aspect of the invention the object is achieved by a computer program directly loadable into the internal memory of a computer, comprising software for performing the method described in the above paragraph when said program is run on a computer.

According to another aspect of the invention the object is achieved by a computer readable medium, having a program recorded thereon, where the program is to make a computer perform the method described in the penultimate paragraph above.

According to still another aspect of the invention the object is achieved by a signal decoder for producing a wide-band acoustic signal from a narrow-band acoustic signal as initially described, which is characterised in that the signal decoder is arranged to allocate a parameter to a particular wide-band frequency component based on a corresponding confidence level.

According to a preferred embodiment of the invention, the decoder thereby allows a relatively high parameter value to be allocated to a frequency component if the confidence level indicates a comparatively high degree certainty, whereas it allows a relatively low parameter value to be allocated to a frequency component whose confidence level indicates a comparatively low degree certainty.

In comparison to the previously known solutions, the proposed solution significantly reduces the amount of artefacts being introduced when extending a narrow-band acoustic signal to a wide-band representation. Consequently, a human listener perceives a drastically improved sound quality. This is an especially desired result, since the perceived sound quality is deemed to be a key factor in the success of future telecommunication applications.

BRIEF DESCRIPTION OF THE DRAWINGS

The present invention is now to be explained more closely by means of preferred embodiments, which are disclosed as examples, and with reference to the attached drawings.

DESCRIPTION OF PREFERRED EMBODIMENTS OF THE INVENTION

Figure 1:
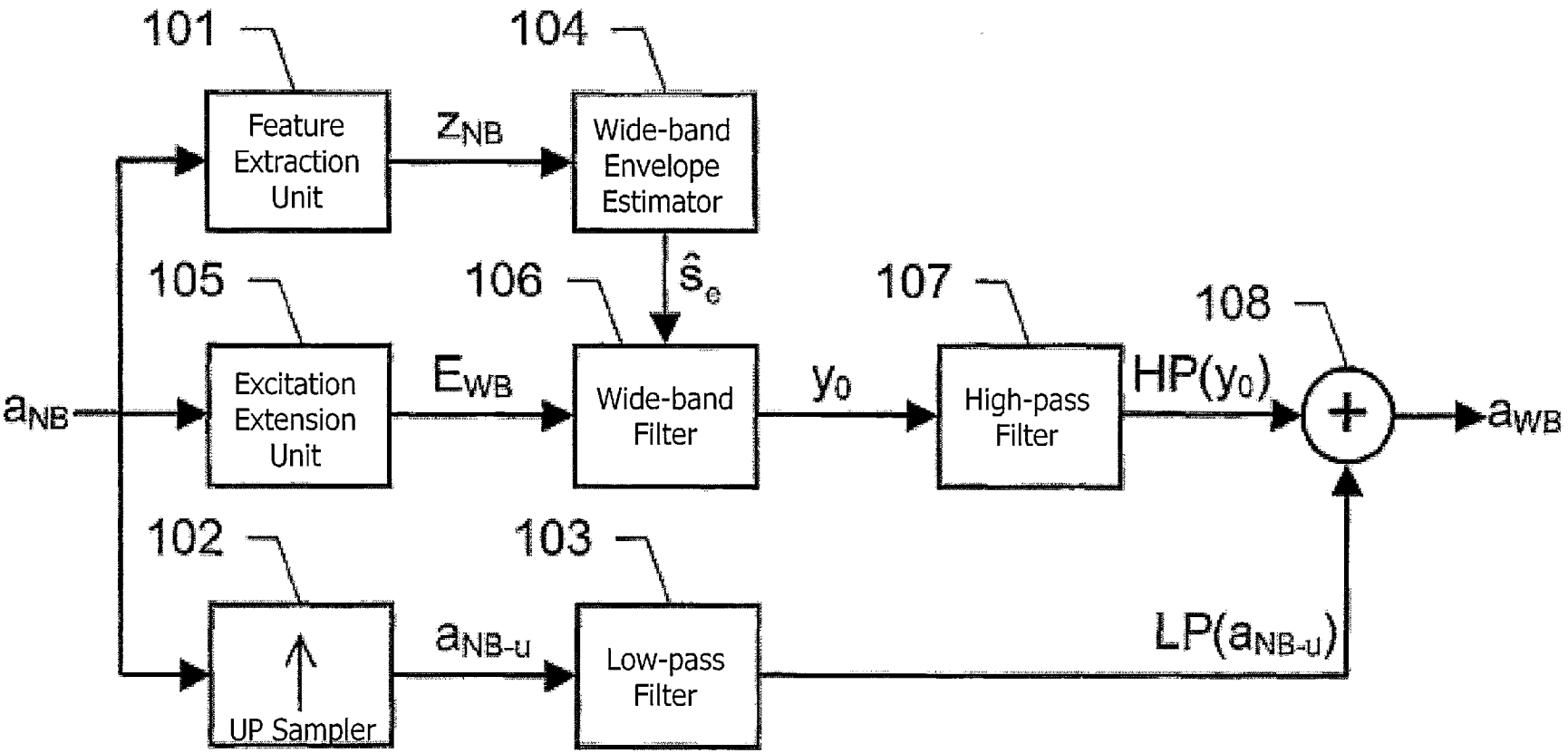
FIG. 1 shows a block diagram over a general signal decoder according to the invention, FIG. 2 exemplifies a spectrum of a typical acoustic source signal in the form of a speech signal, FIG. 3 exemplifies a spectrum of the acoustic source signal in FIG. 2 after having been passed through a narrow-band channel, FIG. 4 exemplifies a spectrum of the acoustic signal corresponding to the spectrum in FIG. 3 after having been extended to a wide-band acoustic signal according to the invention.
Figure 2:
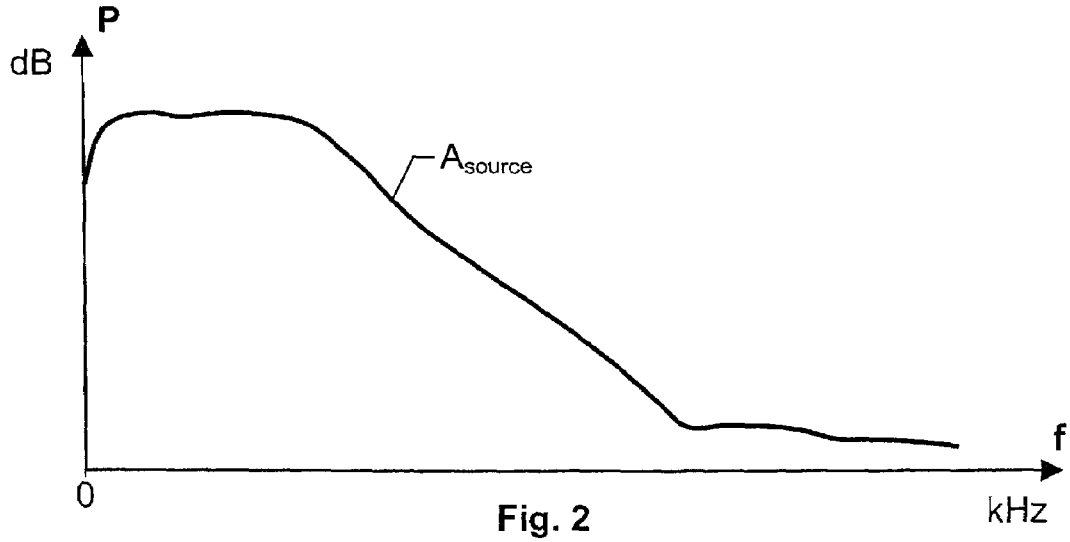
Figure 3:
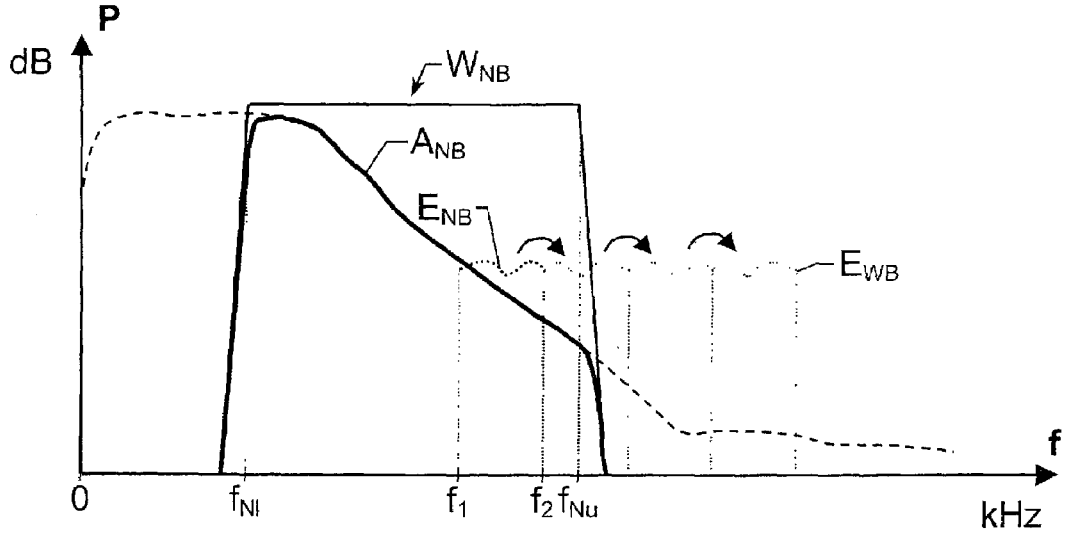
Figure 4:
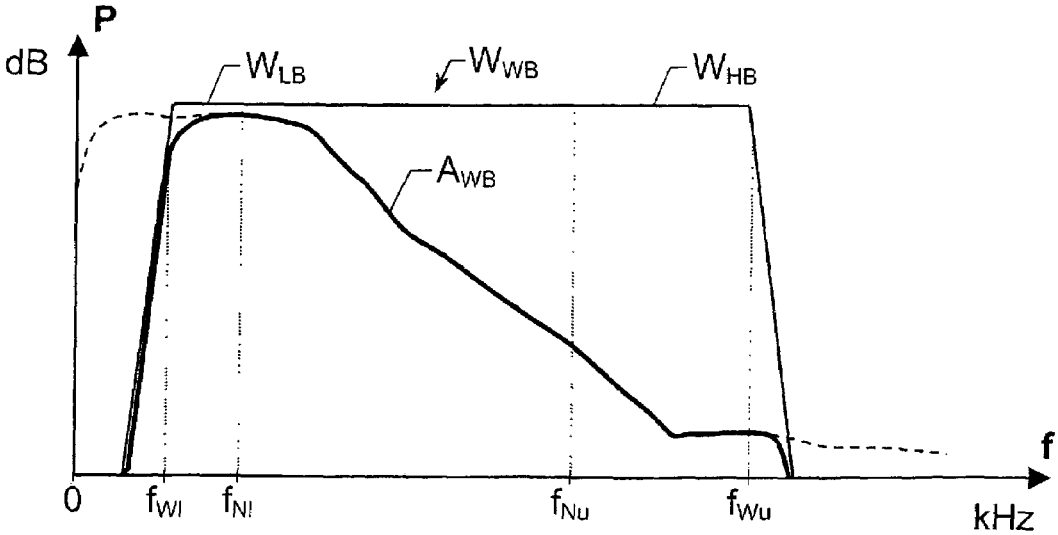

FIG. 1 shows a block diagram over a general signal decoder according to the invention, which aims at producing a wide-band acoustic signal $a_{WB}$ on basis of a received narrow-band signal $a_{NB}$, such that the wide-band acoustic signal $a_{WB}$ perceptually resembles an estimated acoustic source signal $a_{source}$ as much as possible. It is here presumed that the acoustic source signal $a_{source}$ has a spectrum $A_{source}$, which is at least as wide as the bandwidth $W_{WB}$ of the wide-band acoustic signal $a_{WB}$ and that the wide-band acoustic signal $a_{WB}$ has a wider spectrum $A_{WB}$ than the spectrum $A_{NB}$ of the narrow-band acoustic signal $a_{NB}$, which has been transported via a narrow-band channel that has a bandwidth $W_{NB}$. These relationships are illustrated in the FIGS. 2-4. Moreover, the bandwidth $W_{WB}$ may be sub-divided into a low-band $W_{LB}$ including frequency components between a low-most bandwidth limit $f_{WI}$ below a lower bandwidth limit $f_{NI}$ of the narrow-band channel and the lower bandwidth limit $f_{NI}$ respective a high-band $W_{HB}$ including frequency components between an upper-most bandwidth limit $f_{Wu}$ above an upper bandwidth limit $f_{Nu}$ of the narrow-band channel and the upper bandwidth limit $f_{Nu}$.

The proposed signal decoder includes a feature extraction unit 101, an excitation extension unit 105, an up-sampler 102, a wide-band envelope estimator 104, a wide-band filter 106, a low-pass filter 103, a high-pass filter 107 and an adder 108. The feature extraction unit's 101 function will be described in the following paragraph, however, the remaining units 102-108 will instead be described with reference to the embodiment of the invention shown in FIG. 5.

The signal decoder receives a narrow-band acoustic signal $a_{NB}$, either via a communication link (e.g. in PSTN) or from a storage medium (e.g. a digital memory). The narrow-band acoustic signal $a_{NB}$ is fed in parallel to the feature extraction unit 101, the excitation extension unit 105 and the up-sampler 102. The feature extraction unit 101 generates at least one essential feature $z_{NB}$ from the narrow-band acoustic signal $a_{NB}$. The at least one essential feature $z_{NB}$ is used by the following wide-band envelope estimator 104 to produce a wide-band envelope estimation $\hat{S}_e$. A Gaussian mixture model (GMM) may, for instance, be utilised to model the dependencies between the narrow-band feature vector $Z_{NB}$ and a wide-/high-band feature vector $z_{WB}$. The wide-/high band feature vector $z_{WB}$ contains, for instance, a description of the spectral envelope and the logarithmic energy-ratio between the narrow-band and a wide-/high-band. The narrow-band feature vector $Z_{NB}$ and the wide-/high-band feature vector $z_{WB}$ are combined into a joint feature vector $z=[Z_{NB}, z_{WB}]$. The GMM models a joint probability density function $f_z(z)$ of a random variable feature vector Z, which can be expressed as:

$$f_z(z) = \sum_{m=1}^{M} \alpha_m f_z(z \mid \theta_m)$$

where M represents a total number of mixture components, $\alpha_m$ is a weight factor for a mixture number m and $f_z(z|\theta_m)$ is a multivariate Gaussian distribution, which in turn is described by:

$$f_z(z \mid \theta_m) = \frac{1}{(2\pi)^{d2}|C_m|^{12}} \exp\left(-\frac{1}{2}(z-\mu_{zm})^t C_m^{-1}(z-\mu_{zm})\right)$$

where $\mu_m$ represents a mean vector and $C_m$ is a covariance matrix being collected in the variable $\theta_m=\{\mu_m, C_m\}$ and d represents a feature dimension. According to an embodiment of the invention the feature vector z has 22 dimensions and consists of the following components:

a narrow-band spectral envelope, for instance modelled by 15 linear frequency cepstral coefficients (LFCCs), i.e. $x=\{X_1, \ldots, x_{15}\}$, a high-band spectral envelope, for instance modelled by 5 linear frequency cepstral coefficients, i.e. $y=\{y_1, \ldots, y_5\}$, an energy-ratio variable g denoting a difference in logarithmic energy between the high-band and the narrow-band, i.e. $g=y_0-x_0$, where $y_0$ is the logarithmic high-band energy and $x_0$ is the logarithmic narrow-band energy, and a measure representing a degree of voicing r. The degree of voicing r may, for instance, be determined by localising a maximum of a normalised autocorrelation function within a lag range corresponding to 50-400 Hz.

According to an embodiment of the invention, the weight factor $\alpha_m$ and the variable $\theta_m$ for m=1, . . . , M are obtained by applying the so-called estimate-maximise (EM) algorithm on a training set being extracted from the so-called TIMIT-database (TIMIT=Texas Instruments/Massachusetts Institute of Technology).

The size of the training set is preferably 100 000 non-overlapping 20 ms wide-band signal segments. The features z are then extracted from the training set and their dependencies are modelled by, for instance, a GMM with 32 mixture components (i.e. M=32).

Figure 5:
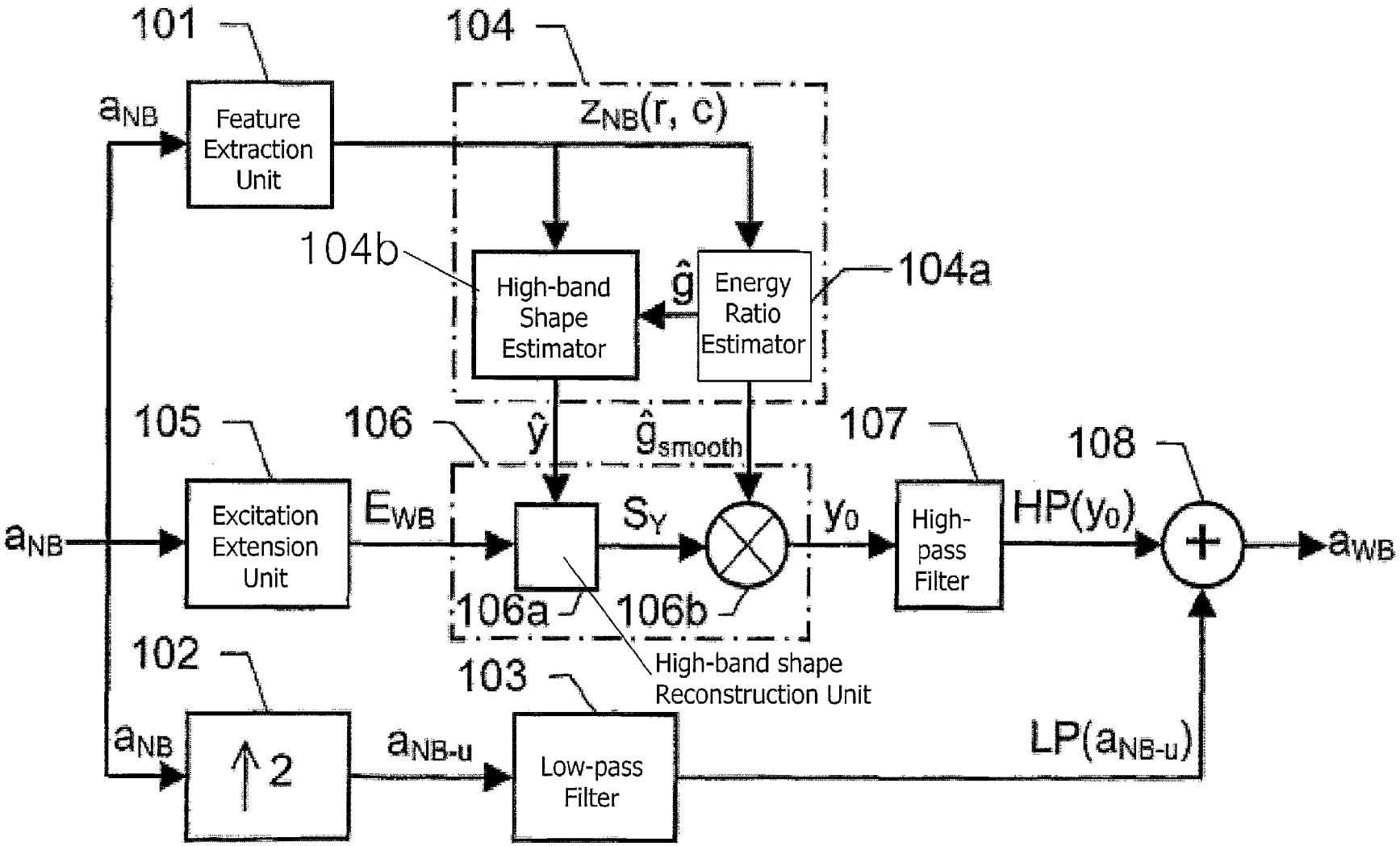
FIG. 5 shows a block diagram over a signal decoder according to an embodiment of the invention.

FIG. 5 shows a block diagram over a signal decoder according to an embodiment of the invention. By way of introduction, the over all working principle of the decoder is described. Next, the operation of the specific units included in the decoder will be described in further detail.

Figure 6:
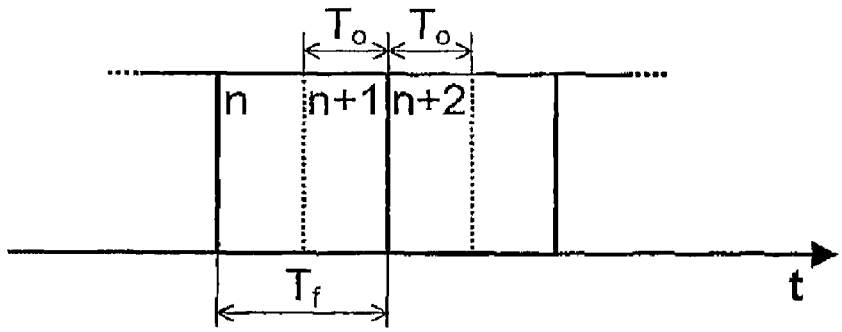
FIG. 6 illustrates a narrow-band frame format according to an embodiment of the invention.

The signal decoder receives a narrow-band acoustic signal $a_{NB}$ in the form of segments, which each has a particular extension in time $T_f$, e.g. 20 ms. FIG. 6 illustrates an example narrow-band frame format according to an embodiment of the invention, where a received narrow-band frame n is followed by sub-sequent frames n+1 and n+2. Preferably, adjacent segments overlap each other to a specific extent $T_o$, e.g. corresponding to 10 ms. According to an embodiment of the invention, 15 cepstral coefficients x and a degree of voicing r are repeatedly derived from each incoming narrow-band segment n, n+1, n+2 etc.

Then, an estimate of an energy-ratio between the narrow-band and a corresponding high-band is derived by a combined usage of an asymmetric cost-function and an a-posteriori distribution of energy-ratio based on the narrow-band shape (being modelled by the cepstral coefficients x) and the narrow-band voicing parameter (described by the degree of voicing r). The asymmetric cost-function penalizes over-estimates of the energy-ratio more than under-estimates of the energy-ratio. Moreover, a narrow a-posteriori distribution results in less penalty on the energy-ratio than a broad a-posteriori distribution. The energy-ratio estimate, the narrow-band shape x and the degree of voicing r together form a new a-posteriori distribution of the high-band shape. An MMSE estimate of the high-band envelope is also computed on basis of the energy-ratio estimate, the narrow-band shape x and the degree of voicing r. Subsequently, the decoder generates a modified spectral-folded excitation signal for the high-band. This excitation is then filtered with the energy-ratio controlled high-band envelope and added to the narrow-band to form a wide-band signal $a_{WB}$, which is fed out from the decoder.

The feature extraction unit 101 receives the narrow-band acoustic signal $a_{NB}$ and produces in response thereto at least one essential feature $z_{NB}(r, c)$ that describes particular properties of the received narrow-band acoustic signal $a_{NB}$. The degree of voicing r, which represents one such essential feature $z_{NB}(r, c)$, is determined by localising a maximum of a normalised autocorrelation function within a lag range corresponding to 50-400 Hz. This means that the degree of voicing r may be expressed as:

$$r = \max_{20 \le r \le 160} \frac{\sum_{n=0}^{N-1} s(n)s(n+\tau)}{\sqrt{\sum_{k=0}^{N-1} s(k)^2 \sum_{i=0}^{N-1} s(i+\tau)^2}}$$

where s=s(1), . . . , s(160) is a narrow-band acoustic segment having a duration of $T_f$ (e.g. 20 ms) being sampled at, for instance, 8 kHz.

Figure 7:
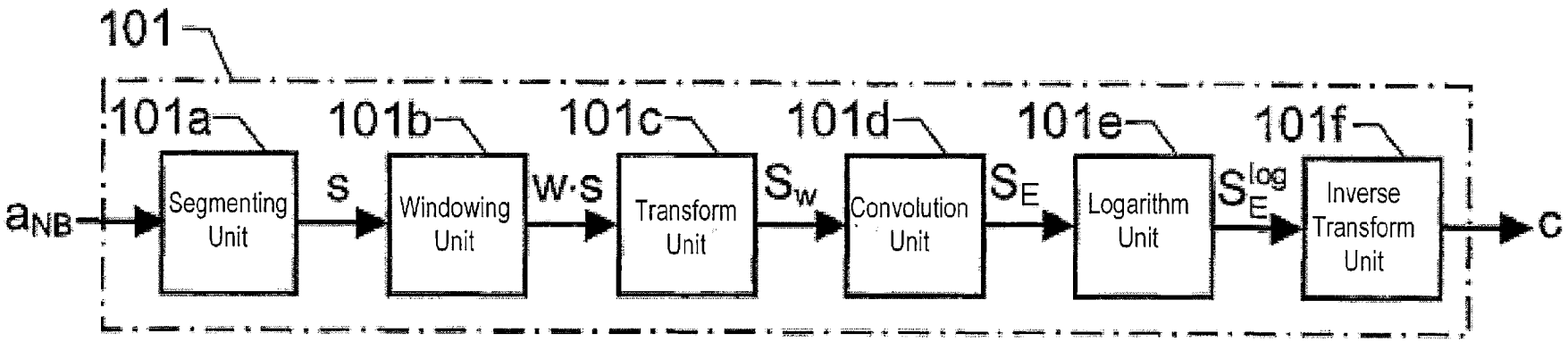
FIG. 7 shows a block diagram over a part of a feature extraction unit according to an embodiment of the invention.

The spectral envelope c is here represented by LFCCs. FIG. 7 shows a block diagram over a part of the feature extraction unit 101, which is utilised for determining the spectral envelope c according to this embodiment of the invention.

A segmenting unit 101*a* separates a segment s of the narrow-band acoustic signal $a_{NB}$ that has a duration of $T_f$=20 ms. A following windowing unit 101*b* windows the segment s with a window-function w, which may be a Hamming-window. Then, a transform unit 101*c* computes a corresponding spectrum $S_W$ by means of a fast Fourier transform, i.e. $S_w$=FFT(w·s). The envelope $S_E$ of the spectrum $S_W$ of the windowed narrow-band acoustic signal $a_{NB}$ is obtained by convolving the spectrum $S_W$ with a triangular window $W_T$ in the frequency domain, which e.g. has a bandwidth of 100 Hz, in a following convolution unit 101*d*. Thus, $S_E=S_W*W_T$.

A logarithm unit 101*e* receives the envelope $S_E$ and computes a corresponding logarithmic value $S_E^{log}$ according to the expression:

$$S_E^{log}=20 \log_{10}(S_E)$$

Finally, an inverse transform unit 101*f* receives the logarithmic value $S_E^{log}$ and computes an inverse fast Fourier transform thereof to represent the LFCCs, i.e.:

$$c=IFFT(S_E^{log})$$

where c is a vector of linear frequency cepstral coefficients. A first component $c_0$ of the vector c constitutes the log energy of the narrow-band acoustic segment s. This component $c_0$ is further used by a high-band shape reconstruction unit 106*a* and an energy-ratio estimator 104*a* that will be described below. The other components $c_1, \ldots, C_{15}$ in the vector c are used to describe the spectral envelope x, i.e. $x=[c_1, \ldots, C_{15}]$.

Figure 8:
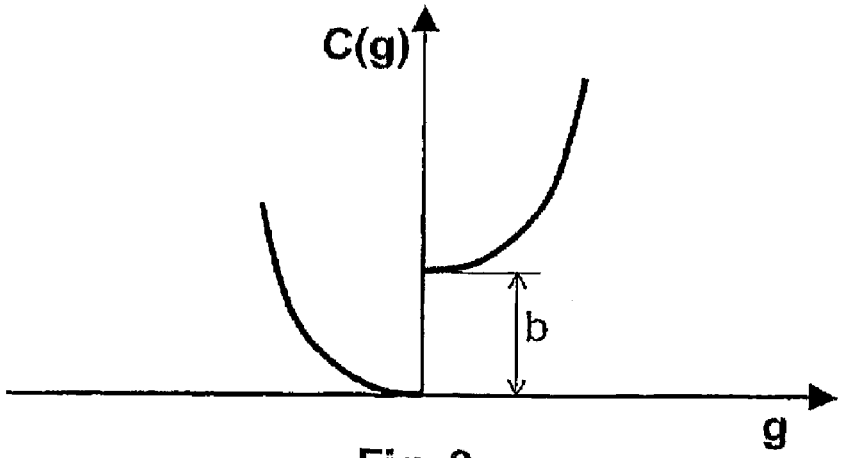
FIG. 8 shows a graph over an asymmetric cost-function, which penalizes over-estimates of an energy-ratio between the high-band and the narrow-band according to an embodiment of the invention.

The energy-ratio estimator 104*a*, which is included in the wide-band envelope estimator 104, receives the first component $c_0$ in the vector of linear frequency cepstral coefficients c and produces, on basis thereof, plus on basis of the narrow-band shape x and the degree of voicing r an estimated energy-ratio $\hat{g}$ between the high-band and the narrow-band. In order to accomplish this, the energy-ratio estimator 104*a* uses a quadratic cost-function, as is common practice for parameter estimation from a conditioned probability function. A standard MMSE estimate $\hat{g}_{MMSE}$ is derived by using the a-posteriori distribution of the energy-ratio given the narrow-band shape x and the degree of voicing r together with the quadratic cost-function, i.e.:

$$\begin{aligned}
\hat{g}_{MMSE} &= \underset{\hat{y}}{\operatorname{argmin}} \int_{\Omega_g} (\hat{g}-g)^2 f_{G|XR}(g \mid x, r)dg \\
&= E[G \mid X = x, R = r] \\
&= \int_{\Omega_g} g \frac{\sum_{m=1}^{M} \alpha_m f_{GXR}(g, x, r \mid \theta_m)}{\sum_{k=1}^{M} \alpha_k f_{XR}(x, r \mid \theta_k)} dg \\
&= \sum_{m=1}^{M} \frac{\alpha_m f_{XR}(x, r \mid \theta_m)}{\sum_{k=1}^{M} \alpha_k f_{XR}(x, r \mid \theta_k)} \int_{\Omega_g} g f_{G|XR}(g \mid x, r, \theta_m)dg \\
&= \sum_{m=1}^{M} w_m(x, r) \int_{\Omega_g} g f_{G|XR}(g \mid x, r, \theta_m)dg \\
&= \sum_{m=1}^{M} w_m(x, r) \int_{\Omega_g} g f_G(g \mid \theta_m)dg \\
&= \sum_{m=1}^{M} w_m(x, r)\mu_{y_m}
\end{aligned}$$

where in the second last step, the fact is used, that each individual mixture component has a diagonal covariance matrix and, thus, independent components. Since an over-estimation of the energy-ratio is deemed to result in a sound that is perceived as annoying by a human listener, an asymmetric cost-function is used instead of a symmetric ditto. Such function is namely capable of penalising over-estimates more that under-estimates of the energy-ratio. FIG. 8 shows a graph over an exemplary asymmetric cost-function, which thus penalizes over-estimates of the energy-ratio. The asymmetric cost-function in FIG. 8 may also be expressed as:

$$C=bU(\hat{g}-g)+(\hat{g}-g)^2$$

where bU(•) represents a step function with an amplitude b. The amplitude b can be regarded as a tuning parameter, which provides a possibility to control the degree of penalty for the over-estimates. The estimated energy-ratio $\hat{g}$ can be expressed as:

$$\hat{g} = \underset{g}{\operatorname{argmin}} \int_{\Omega_g} \left(b \bigcup (\hat{g}-g) + (\hat{g}-g)^2\right) f_{G|XR}(g \mid x, r)dg$$

The estimated energy-ratio $\hat{g}$ is found by differentiating the right-hand side of the expression above and set it equal to zero. Assuming that the order of differentiation and integration may be interchanged the derivative of the above expression can be written as:

$$\sum_{m=1}^{M} w_m(x, r) \int_{\Omega_g} (b\delta(\hat{g}-g) + 2(\hat{g}-g)) f_G(g \mid \theta_m)dg = 0,$$

$$\sum_{m=1}^{M} w_m(x, r) b f_G(\hat{g} \mid \theta_m) + 2\hat{g} - 2\sum_{m=1}^{M} w_m(x, r)\mu_{y_m} = 0,$$

which in turn yields an estimated energy-ratio $\hat{g}$ as:

$$\hat{g} = \sum_{m=1}^{M} w_m(x, r)\mu_{y_m} - \frac{b}{2}\sum_{m=1}^{M} w_m(x, r) f_G(\hat{g} \mid \theta_m)$$

The above equation is preferably solved by a numerical method. for instance, by means of a grid search. As is apparent from the above, the estimated energy-ratio $\hat{g}$ depends on the shape of the posterior distribution. Consequently, the penalty on the MMSE estimate $\hat{g}$MMSE of the energy-ratio depends on the width of the posterior distribution. If the a-posteriori distribution $f_{G|XR}(g|x,r)$ is narrow, this means that the MMSE estimate $\hat{g}$MMSE is more reliable than if the a-posteriori distribution is broad. The width of the a-posteriori distribution can thus be seen as a confidence level indicator.

Other parameters than LFCCs can be used as alternative representations of the narrow-band spectral envelope x. Line Spectral Frequencies (LSF), Mel Frequency Spectral Coefficients (MFCC), and Linear Prediction Coefficients (LPC) constitute such alternatives. Furthermore, spectral temporal variations can be incorporated into the model either by including spectral derivatives in the narrow-band feature vector $z_{NB}$ and/or by changing the GMM to a hidden Markov model (HMM).

Moreover, a classification approach may instead be used to express the confidence level. This means that a classification error is exploited to indicate a degree of certainty for a high-band estimate (e.g. with respect to energy $y_0$ or shape x).

According to an embodiment of the invention, it is presumed that the underlying model is GMM. A so-called Bayes classifier can then be constructed to classify the narrow-band feature vector $z_{NB}$ into one of the mixture components of the GMM. The probability that this classification is correct can also be computed. Said classification is based on the assumption that the observed narrow-band feature vector z was generated from only one of the mixture components in the GMM. A simple scenario of a GMM that models the distribution of a narrow-band feature z using two different mixture components $s_1$; $S_2$ (or states) is shown below.

$$f_z(z)=f_{z,s}(z,s_1)+f_{z,s}(z,s_2)$$

Suppose a vector $z_0$ is observed and the classification finds that the vector most likely originates from a realisation of the distribution in state $s_1$. Using Bayes rule, the probability $P(S=s_1|Z=z_0)$ that the classification was correct, can be computed as:

$$P(S=s_1 \mid Z=z_0)=\lim_{\Delta\to 0}P\left(S=s_1 \,\middle|\, z_0-\frac{\Delta}{2}<Z<z_0+\frac{\Delta}{2}\right)$$

$$=\lim_{\Delta\to 0}\frac{\int_{z_0-\frac{\Delta}{2}}^{z_0+\frac{\Delta}{2}} f_{Z|S}(z \mid s_1)dz\cdot P(s_1)dz}{\int_{z_0-\frac{\Delta}{2}}^{z_0+\frac{\Delta}{2}} f_{Z|S}(z \mid s_1)\cdot P(s_1)+f_{Z|S}(z \mid s_2)\cdot P(s_2)dz}$$

$$=\frac{f_{Z|S}(z_0 \mid s_1)\cdot P(s_1)}{f_{Z|S}(z_0 \mid s_1)\cdot P(s_1)+f_{Z|S}(z_0 \mid s2)\cdot P(s_2)}$$

The probability of a correct classification can then be regarded as a confidence level. It can thus also be used to control the energy (or shape) of the bandwidth extended regions $W_{LB}$ and $W_{HB}$ of the wide-band acoustic signal $a_{WB}$, such that a relatively high energy is allocated to frequency components being associated with a confidence level that represents a comparatively high degree certainty, and a relatively low energy is allocated to frequency components if the confidence level being associated with a confidence level that represents a comparatively low degree certainty.

The GMM is typically trained by means of an estimate-maximise (EM) algorithm in order to find the maximum likelihood estimate of the unknown, however, fixed parameters of the GMM given the observed data. According to an alternative embodiment of the invention, the unknown parameters of the GMM are instead themselves regarded as stochastic variables. A model uncertainty may also be incorporated by including a distribution of the parameters into the standard GMM. Consequently, the GMM would be a model of the joint distribution $f_{z,\Theta}(z,\theta)$ of feature vectors z and the underlying parameters θ, i.e.:

$$f_{Z,\Theta}(z,\theta)=\sum_{m=1}^{M}\alpha_m f_{Z|\Theta}(z \mid \theta)f_\Theta(\theta)$$

The distribution $f_{z,\Theta}(z,\theta)$ is then used to compute the estimates of the high-band parameters. For instance, as will be shown in further detail below, the expression for calculating the estimated energy-ratio ĝ, when using a proposed asymmetric cost-function, is:

$$\hat{g}=\underset{g}{\operatorname{argmin}}\int_{\Omega_g}\left(b\cup(\hat{g}-g)+(\hat{g}-g)^2\right)f_{G|XR}(g \mid x,r)dg$$

An incorporation of the model uncertainty for the estimated energy-ratio ĝ results in the expression:

$$\hat{g}=\underset{g}{\operatorname{argmin}}\int_{\Omega g}\int_{\Omega g}\left(b\cup(\hat{g}-g)+(\hat{g}-g)^2\right)f_{G|XR}(g \mid x,r,\theta)f_\Theta(\theta)dgd\theta$$

Whenever the distribution $f_\Theta(\theta)$ and/or the distribution $f_{G|XR}(x,r,\theta)$ are broad, this will be interpreted as an indicator of a comparatively low confidence level, which in turn will result in a relatively low energy being allocated to the corresponding frequency components. Otherwise, (i.e. if both distributions $f_\Theta(\theta)$ and $f_{G|XR}(x,r,\theta)$ are narrow) it is presumed that the confidence level is comparatively high, and therefore, a relatively high energy may be allocated to the corresponding frequency components.

Rapid (and undesired) fluctuations of the estimated energy ratio ĝ are avoided by means of temporally smoothing the estimated energy ratio ĝ into a temporally smoothed energy ratio estimate $\hat{g}_{smooth}$. This can be accomplished by using a combination of a current estimation and, for instance, two previous estimations according to the expression:

$$\hat{g}_{smooth}=0{,}5\hat{g}_n+0{,}3\hat{g}_{n-1}+0{,}2\hat{g}_{n-2}$$

where n represents a current segment number, n−1 a previous segment number and n−2 a still earlier segment number.

A high-band shape estimator 104*b* is included in the wide-band envelope estimator 104 in order to create a combination of the high-band shape and energy-ratio, which is probable for typical acoustic signals, such as speech signals. An estimated high-band envelope ŷ is produced by conditioning the estimated energy ratio ĝ, the narrow-band shape and the degree of voicing r in narrow-band acoustic segment s.

A GMM with diagonal covariance matrices gives an MMSE estimate of the high-band shape $\hat{Y}_{MMSE}$ according to the expression:

$$\hat{y}_{MMSE}=E[Y \mid X=x, R=r, G=\hat{g}]$$

$$=\sum_{m=1}^{M}\frac{\alpha_m f_{XRG}(x,r,\hat{g} \mid \theta_m)\mu_{ym}}{\sum_{n=1}^{N}\alpha_n f_{XRG}(x,r,\hat{g} \mid \theta_n)}$$

The excitation extension unit 105 receives the narrow-band acoustic signal $a_{NB}$ and, on basis thereof, produces an extended excitation signal $E_{WB}$. As mentioned earlier, FIG. 3 shows an example spectrum $A_{NB}$ of an acoustic source signal $a_{source}$ after having been passed through a narrow-band channel that has a bandwidth $W_{NB}$.

Basically, the extended excitation signal $E_{WB}$ is generated by means of spectral folding of a corresponding excitation signal $E_{NB}$ for the narrow-band acoustic signal $a_{NB}$ around a particular frequency. In order to ensure a sufficient energy in a frequency region closest above the upper band limit $f_{Nu}$ of the narrow-band acoustic signal $a_{NB}$, a part of the narrow-band excitation spectrum $E_{NB}$ between a first frequency $f_1$ and a second frequency $f_2$ (where $f_1<f_2<f_{Nu}$) is cut out, e.g $f_1$=2kHz and $f_2$=3 kHz, and repeatedly up-folded around first $f_2$, then $2f_2-f_1$, $3f_2-2f_1$ etc as many times as is necessary to cover at least the entire band up to the upper-most band limit $f_{Wu}$. Hence, a wide-band excitation spectrum $E_{WB}$ is obtained. According to a preferred embodiment of the invention, the obtained excitation spectrum $E_{WB}$ is produced such that it smoothly evolves to a white noise spectrum. This namely avoids an overly periodic excitation at the higher frequencies of the wide-band excitation spectrum $E_{WB}$. For instance, the transition between the up-folded narrow-band excitation spectrum $E_{NB}$ may be set such that at the frequency f=6 kHz the noise spectrum dominates totally over the periodic spectrum. It is preferable, however not necessary, to allocate an amplitude of the wide-band excitation spectrum $E_{WB}$ being equal to the mean value of the amplitude of the narrow-band excitation spectrum $E_{NB}$. According to an embodiment of the invention, the transition frequency depends on the confidence level for the higher frequency components, such that a comparatively high degree of certainty for these components result in a relatively high transition frequency, and conversely, a comparatively low degree of certainty for these components result in a relatively low transition frequency.

The high band shape estimator 106*a* in the wide-band filter 106 receives the estimated high-band envelope $\hat{y}$ from the high band shape estimator 104*b* and receives the wide-band excitation spectrum $E_{WB}$ from the excitation extension unit 105. On basis of the received signals $\hat{y}$ and $E_{WB}$, the high band shape estimator 106*a* produces a high-band envelope spectrum $S_Y$ that is shaped with the estimated high-band envelope $\hat{y}$. This frequency shaping of the excitation is performed in the frequency domain by (i) computing the wide-band excitation spectrum $E_{WB}$ (ii) multiplying the high-band part thereof with a spectrum $S_Y$ of the estimated high-band envelope $\hat{y}$. The high-band envelope spectrum $S_Y$ is computed as:

$$S_Y = 10^{\frac{FFT(\hat{y}_{MMSE})}{20}}$$

A multiplier 106*b* receives the high-band envelope spectrum $S_Y$ from the high band shape estimator 106*a* and receives the temporally smoothed energy ratio estimate $\hat{g}_{smooth}$ from the energy ratio estimator 104*a*. On basis of the received signals $S_Y$ and $\hat{g}_{smooth}$ the multiplier 106*b* generates a high-band energy $y_0$. The high-band energy $y_0$ is determined by computing a first LFCC using only a high-band part of the spectrum between $f_{Nu}$ and $f_{Wu}$ (where e.g. $f_{Nu}$=3,3 kHz and $f_{Wu}$=8,0 kHz). The high-band energy $y_0$ is adjusted such that it satisfies the equation:

$$y_0=\hat{g}_{smooth}+c_0$$

where $c_0$ is the energy of the current narrow-band segment (computed by the feature extraction unit 101) and $\hat{g}_{smooth}$ is the energy ratio estimate (produced by the energy ratio estimator 104*a*).

The high-pass filter 107 receives the high-band energy signal $y_0$ from the high-band shape reconstruction unit 106 and produces in response thereto a high-pass filtered signal $HP(y_0)$. Preferably, the high-pass filter's 107 cut-off frequency is set to a value above the upper bandwidth limit $f_{Nu}$ for the narrow-band acoustic signal $a_{NB}$, e.g. 3,7 kHz. The stop-band may be set to a frequency in proximity of the upper bandwidth limit $f_{Nu}$ for the narrow-band acoustic signal $a_{NB}$, e.g. 3,3 kHz, with an attenuation of −60 dB.

The up-sampler 102 receives the narrow-band acoustic signal $a_{NB}$ and produces, on basis thereof, an up-sampled signal $a_{NB-u}$ that has a sampling rate, which matches the bandwidth $W_{WB}$ of the wide-band acoustic signal $a_{WB}$ that is being delivered via the signal decoder's output. Provided that the up-sampling involves a doubling of the sampling frequency, the up-sampling can be accomplished simply by means of inserting a zero valued sample between each original sample in the narrow-band acoustic signal $a_{NB}$. Of course, any other (non-2) up-sampling factor is likewise conceivable. In that case, however, the up-sampling scheme becomes slightly more complicated. Due to the aliasing effect of the up-sampling, the resulting up-sampled signal $a_{NB-u}$ must also be low-pass filtered. This is performed in the following low-pass filter 103, which delivers a low-pass filtered signal $LP(a_{NB-u})$ on its output. According to a preferred embodiment of the invention, the low-pass filter 103 has an approximate attenuation of −40 dB of the high-band $W_{HB}$.

Finally, the adder 108 receives the low-pass filtered signal $LP(a_{NB-u})$, receives the high-pass filtered signal $HP(y_0)$ and adds the received signals together and thus forms the wide-band acoustic signal $a_{WB}$, which is delivered on the signal decoder's output.

Figure 9:
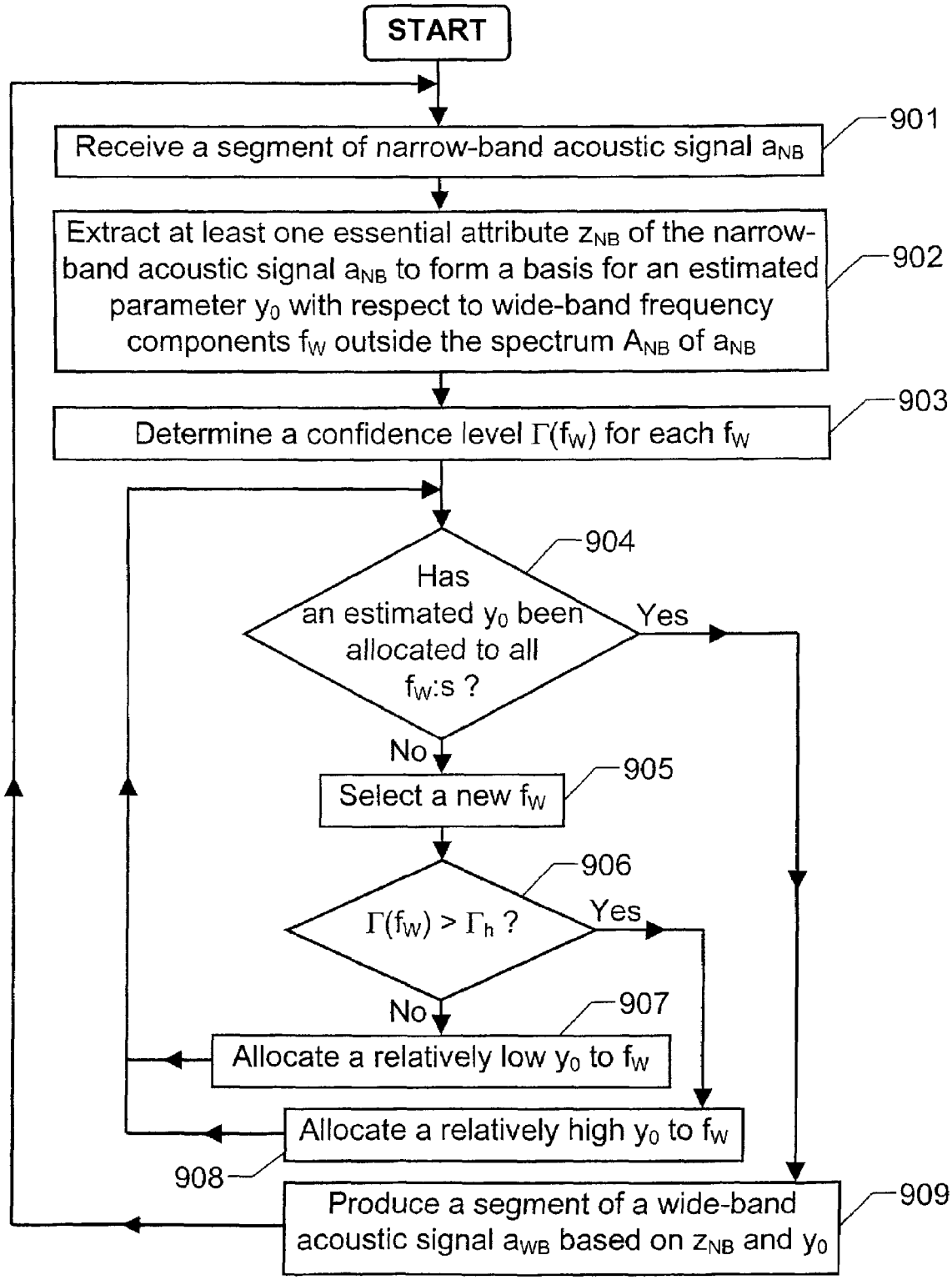
FIG. 9 illustrates, by means of a flow diagram, a general method according to the invention.

In order to sum up, a general method of producing a wide-band acoustic signal on basis of a narrow-band acoustic signal will now be described with reference to a flow diagram in FIG. 9.

A first step 901 receives a segment of the incoming narrow-band acoustic signal. A following step 902, extracts at least one essential attribute from the narrow-band acoustic signal, which is to form a basis for estimated parameter values of a corresponding wide-band acoustic signal. The wide-band acoustic signal includes wide-band frequency components outside the spectrum of the narrow-band acoustic signal (i.e. either above, below or both).

A step 903 then determines a confidence level for each wide-band frequency component. Either a specific confidence level is assigned to (or associated with) each wide-band frequency component individually, or a particular confidence level refers collectively to two or more wide-band frequency components. Subsequently, a step 904 investigates whether a confidence level has been allocated to all wide-band frequency components, and if this is the case, the procedure is forwarded to a step 909. Otherwise, a following step 905 selects at least one new wide-band frequency component and allocates thereto a relevant confidence level. Then, a step 906 examines if the confidence level in question satisfies a condition $\Gamma_h$ for a comparatively high degree of certainty (according to any of the above-described methods). If the condition $\Gamma_h$ is fulfilled, the procedure continues to a step 908 in which a relatively high parameter value is allowed to be allocated to the wide-band frequency component(s) and where after the procedure is looped back to the step 904. Otherwise, the procedure continues to a step 907 in which a relatively low parameter value is allowed to be allocated to the wide-band frequency component(s) and where after the procedure is looped back to the step 904.

The step 909 finally produces a segment of the wide-band acoustic signal, which corresponds to the segment of the narrow-band acoustic signal that was received in the step 901.

Naturally, all of the process steps, as well as any subsequence of steps, described with reference to the FIG. 9 above may be carried out by means of a computer program being directly loadable into the internal memory of a computer, which includes appropriate software for performing the necessary steps when the program is run on a computer. The computer program can likewise be recorded onto arbitrary kind of computer readable medium.

The term "comprises/comprising" when used in this specification is taken to specify the presence of stated features, integers, steps or components. However, the term does not preclude the presence or addition of one or more additional features, integers, steps or components or groups thereof.

The invention is not restricted to the described embodiments in the figures, but may be varied freely within the scope of the claims.

The invention claimed is:

1. A method of producing in a signal decoder, a wide-band acoustic signal ($a_{WB}$) based on a narrow-band acoustic signal ($a_{NB}$), the spectrum ($A_{WB}$) of the wide-band acoustic signal ($a_{WB}$) having a larger bandwidth than the spectrum ($A_{NB}$) of the narrow-band acoustic signal ($a_{NB}$), the method comprising:

receiving the narrow-band acoustic signal ($a_{NB}$);

extracting by a feature extraction unit, at least one essential attribute ($z_{NB}(r, c)$, $E_{NB}$) from the narrow-band acoustic signal ($a_{NB}$);

estimating by a parameter estimation unit, a parameter describing aspects of wide-band frequency components outside the spectrum ($A_{NB}$) of the narrow-band acoustic signal ($a_{NB}$) based on the at least one essential attribute ($z_{NB}(r, c)$, $E_{NB}$);

deriving by a confidence level derivation unit, a confidence level which reflects a probability that an estimated parameter value accurately describes a particular wide-band frequency component;

allocating by the signal decoder, the estimated parameter value to the particular wide-band frequency component based on the derived confidence level, wherein the estimated parameter value is allocated such that:

a relatively high parameter value is allocated to the particular wide-band frequency component if the confidence level indicates a comparatively high degree of certainty that the parameter value accurately describes the particular wide-band frequency component; and a relatively low parameter value is allocated to the particular wide-band frequency component if the confidence level indicates a comparatively low degree of certainty that the parameter value accurately describes the particular wide-band frequency component; and outputting the wide-band acoustic signal ($a_{WB}$) to produce an acoustic signal of improved perceived signal quality compared to the narrow-band acoustic signal ($a_{NB}$).

2. A signal decoder for producing a wide-band acoustic signal ($a_{WB}$) from a narrow-band acoustic signal ($a_{NB}$), the spectrum ($A_{WB}$) of the wide-band acoustic signal ($a_{WB}$) having a larger bandwidth than the spectrum ($A_{NB}$) of the narrow-band acoustic signal ($a_{NB}$), the signal decoder comprising:

a feature extraction unit adapted to receive the narrow-band acoustic signal ($a_{NB}$) and, on basis thereof, produce at least one essential attribute ($z_{NB}(r, c)$. $E_{NB}$) of the narrow-band acoustic signal ($a_{NB}$);

at least one band extension unit adapted to receive the narrow-band acoustic signal ($a_{NB}$), receive the at least one essential attribute ($z_{NB}(r, c)$, $E_{NB}$). and, on basis of the received signals, produce the wide-band acoustic signal ($a_{WB}$); and a confidence level derivation unit for deriving a confidence level which reflects a probability that an estimated parameter value accurately describes a particular wide-band frequency component;

wherein the signal decoder is arranged to allocate the estimated parameter value to the particular wide-band frequency component based on the derived confidence level, wherein the signal decoder is arranged to allocate the estimated parameter value such that:

a relatively high parameter value is allocated to the particular wide-band frequency component if the confidence level indicates a comparatively high degree of certainty that the parameter value accurately describes the particular wide-band frequency component; and a relatively low parameter value is allocated to the particular wide-band frequency component if the confidence level indicates a comparatively low degree certainty that the parameter value accurately describes the particular wide-band frequency component.

3. The signal decoder according to claim 2, wherein the parameter value represents a signal energy.

4. The signal decoder according to claim 2, wherein the signal decoder comprises:

an up-sampler adapted to receive the narrow-band acoustic signal ($a_{NB}$) and, on basis thereof, produce an up-sampled signal ($a_{NB-u}$) that has a sampling rate, the sampling rate matching the bandwidth ($W_{WB}$) of the wide-band acoustic signal ($a_{WB}$); and a low-pass filter adapted to receive the up-sampled signal ($a_{NB-u}$) and, in response thereto, produce a low-pass filtered acoustic signal ($LP(a_{NB-u})$).

5. The signal decoder according to claim 4, wherein the up-sampler includes means for producing the up-sampled signal ($a_{NB-u}$) by inserting zero valued samples between samples of the narrow-band acoustic signal ($a_{NB}$).

6. The signal decoder according to claim 2, wherein the signal decoder comprises a wide-band envelope estimator adapted to receive the at least one essential attribute ($Z_{NB}(r, c)$, $E_{NB}$) and, on basis thereof, produce an estimated wide-band envelope ($\hat{S}_e$).

7. The signal decoder according to claim 6, wherein the wide-band envelope estimator comprises an energy ratio estimator adapted to receive the at least one essential attribute ($Z_{NB}(r, c)$, $E_{NB}$) and, in response thereto, produce an estimated energy ratio ($\hat{g}$).

8. The signal decoder according to claim 7, wherein the wide-band envelope estimator comprises a high-band shape estimator adapted to receive the at least one essential attribute ($Z_{NB}(r, c)$, $E_{NB}$), receive the estimated energy ratio ($\hat{g}$), and, on basis of the received signals, produce an estimated high-band envelope ($\hat{y}$).

9. The signal decoder according to claim 6, wherein the signal decoder comprises an excitation extension unit adapted to receive the narrow-band acoustic signal ($a_{NB}$) and, in response thereto, produce an extended excitation spectrum ($E_{WB}$), the extended excitation spectrum ($E_{WB}$) comprising frequency components outside the spectrum ($A_{NB}$) of the narrow-band acoustic signal ($a_{NB}$).

10. The signal decoder according to claim 9, wherein the signal decoder comprises a wide-band filter adapted to receive the extended excitation spectrum ($E_{WB}$), receive the wide-band envelope estimation ($\hat{S}_e$), and, on basis of the received signals, produce a wide-band energy signal ($y_0$).

11. The signal decoder according to claim 10, wherein the wide-band filter comprises a high-band shape-reconstruction unit adapted to receive the extended excitation spectrum ($E_{WB}$), receive the estimated high-band envelope ($\hat{y}$), and, on basis of the received signals, produce a high-band envelope spectrum ($S_Y$).

12. The signal decoder according to claim 11, wherein:

the energy ratio estimator comprises means for producing a temporally smoothed energy ratio estimate ($\hat{g}_{smooth}$) on basis of the at least one essential attribute ($z_{NB}(r, c)$, $E_{NB}$); and the wide-band filter comprises a multiplier adapted to receive the high-band envelope spectrum ($S_Y$), receive the temporally smoothed energy ratio estimate ($\hat{g}_{smooth}$), and, on basis of the received signals, produce the wide-band energy signal ($y_0$).

13. The signal decoder according to claim 9, wherein the signal decoder comprises a high-pass filter adapted to receive the wide-band energy signal ($y_0$) and, in response thereto, produce a high-pass filtered signal ($HP(y_0)$).

14. The signal decoder according to claim 13, wherein the signal decoder comprises an adder adapted to receive the high-pass filtered signal ($HP(y_0)$), receive the low-pass filtered signal ($LP(a_{NB-u})$), and produce the wide-band acoustic signal ($a_{WB}$) as a sum of the received signals.

15. The signal decoder according to claim 6, wherein the wide-band envelope estimator includes means for estimating a high-band ($W_{HB}$) fraction of the wide-band envelope ($\hat{S}_e$) utilizing Gaussian mixture modeling.

16. The signal decoder according to claim 15, wherein the means for estimating a high-band ($W_{HB}$) fraction of the wide-band envelope ($\hat{S}_e$) utilizing Gaussian mixture modeling is adapted to:

classify at least one narrow-band feature vector into a mixture component of a Gaussian mixture model utilizing Bayes classification; and compute a value that indicates the probability that the classification is correct.

17. The signal decoder according to claim 15, wherein the means for estimating a high-band ($W_{HB}$) fraction of the wide-band envelope ($\hat{S}_e$) utilizing Gaussian mixture modeling is adapted to produce a Gaussian mixture model representing a joint distribution of feature vectors and underlying parameters.

18. The signal decoder according to claim 6, wherein the wide-band envelope estimator includes means for estimating a high-band ($W_{HB}$) fraction of the wide-band envelope ($\hat{S}_e$) utilizing hidden Markov modeling.

19. The signal decoder according to claim 2, wherein:

the spectrum ($A_{WB}$) of the wide-band acoustic signal ($a_{WB}$) comprises a low-band ($W_{LB}$) including wide-band frequency components below a lower bandwidth limit ($f_{Nl}$) of the spectrum ($A_{NB}$) of the narrow-band acoustic signal ($a_{NB}$), and a high-band ($W_{HB}$) including wide-band frequency components above an upper bandwidth limit ($f_{Nu}$) of the spectrum ($A_{NB}$) of the narrow-band acoustic signal ($a_{NB}$); and the confidence level derivation unit allocates a confidence level that represents a high degree of certainty to all frequency components in the low-band ($W_{LB}$).

20. The signal decoder according to claim 2, wherein the at least one essential attribute ($z_{NB}(r, c)$, $E_{NB}$) represents a degree of voicing and a spectral envelope (c).

21. The signal decoder according to claim 20, further comprising a normalized auto-correlation function for determining the degree of voicing.

22. The signal decoder according to claim 20, wherein the feature extraction unit is adapted to represent the spectral envelope (c) via linear frequency cepstral coefficients.

23. The signal decoder according to claim 20, wherein the feature extraction unit is adapted to represent the spectral envelope (c) via line spectral frequencies.

24. The signal decoder according to claim 20, wherein the feature extraction unit is adapted to represent the spectral envelope (c) via Mel frequency cepstral coefficients.

25. The signal decoder according to claim 20, wherein the feature extraction unit is adapted to represent the spectral envelope (c) via linear prediction coefficients.

* * * * *

UNITED STATES PATENT AND TRADEMARK OFFICE

CERTIFICATE OF CORRECTION

PATENT NO. : 7,359,854 B2
APPLICATION NO. : 10/119701
DATED : April 15, 2008
INVENTOR(S) : Nilsson et al.

It is certified that error appears in the above-identified patent and that said Letters Patent is hereby corrected as shown below:

In the Specifications:

In Column 1, Line 20, delete "0,3" and insert -- 0.3 --, therefor.

In Column 5, Line 20, delete "$\frac{1}{(2\pi)^{d/2}|C_m|^{1/2}}\exp\left(-\frac{1}{2}(z-\mu_{zm})^T C_m^{-1}(z-\mu_{zm})\right)$" and insert -- $\frac{1}{(2\pi)^{d/2}|C_m|^{1/2}}\exp(-\frac{1}{2}(z-\mu_{zm})^T C_m^{-1}(z-\mu_{zm}))$ --, therefor.

In Column 8, Line 39, delete "$\hat{g}$MMSE" and insert -- $\hat{g}_{MMSE}$ --, therefor.

In Column 8, Line 42, delete "$\hat{g}$MMSE" and insert -- $\hat{g}_{MMSE}$ --, therefor.

In Column 9, Line 26, delete "$\frac{f_{Z|S}(z_0|s_1)\cdot P(s_1)}{f_{Z|S}(z_0|s_1)\cdot P(s_1)+f_{Z|S}(z_0|s_2)\cdot P(s_2)}$" and insert -- $\frac{f_{Z|S}(z_0|s_1)\cdot P(s_1)}{f_{Z|S}(z_0|s_1)\cdot P(s_1)+f_{Z|S}(z_0|s_2)\cdot P(s_2)}$ --, therefor.

In Column 10, Line 11, delete "$f_{G|XR}(x,r,\theta)$" and insert -- $f_{G|XR}(g|x,r,\theta)$ --, therefor.

In Column 10, Line 15, delete "$f_{G|XR}(x,r,\theta)$" and insert -- $f_{G|XR}(g|x,r,\theta)$ --, therefor.

In Column 10, Line 27, delete "$\hat{g}_{smooth}=0,5\hat{g}_n+0,3\hat{g}_{n-1}+0,2\hat{g}_{n-2}$" and insert -- $\hat{g}_{smooth}=0.5\hat{g}_n+0.3\hat{g}_{n-1}+0.2\hat{g}_{n-2}$ --, therefor.

Signed and Sealed this
Twenty-seventh Day of August, 2013

Teresa Stanek Rea
*Acting Director of the United States Patent and Trademark Office*

In Column 11, Lines 46-47, delete "3,3 kHz" and insert -- 3.3 kHz --, therefor.

In Column 11, Line 47, delete "8,0 kHz)." and insert -- 8.0 kHz). --, therefor.

In Column 11, Line 61, delete "3,7 kHz." and insert -- 3.7 kHz. --, therefor.

In Column 11, Line 64, delete "3,3 kHz," and insert -- 3.3 kHz, --, therefor.

In the Claims:

In Column 13, Line 57, in Claim 2, delete "($z_{NB}$(r,c)." and insert -- ($z_{NB}$(r,c), --, therefor.

In Column 13, Line 61, in Claim 2, delete "($z_{NB}$(r,c), $E_{NB}$)." and insert -- ($z_{NB}$(r,c), $E_{NB}$), --, therefor.